US008672546B2

(12) United States Patent
Jariwala et al.

(10) Patent No.: US 8,672,546 B2
(45) Date of Patent: Mar. 18, 2014

(54) DEVICE WITH ATTACHED STORAGE POUCH

(75) Inventors: Hetal N. Jariwala, Albany, CA (US); Eva E. Bauer, Albany, CA (US); Lale Taneri, Istanbul (TR)

(73) Assignee: Flip & Tumble, LLC, Albany, CA (US)

( * ) Notice: Subject to any disclaimer, the term of this patent is extended or adjusted under 35 U.S.C. 154(b) by 52 days.

(21) Appl. No.: 12/568,563

(22) Filed: Sep. 28, 2009

(65) Prior Publication Data

US 2010/0034488 A1 Feb. 11, 2010

Related U.S. Application Data

(63) Continuation of application No. PCT/US2008/065249, filed on May 30, 2008.

(60) Provisional application No. 60/932,252, filed on May 30, 2007.

(51) Int. Cl.
*B65D 30/22* (2006.01)

(52) U.S. Cl.
USPC ..... 383/40; 383/38; 383/2; 383/4

(58) Field of Classification Search
USPC ..... 383/38, 40, 39, 2, 4
See application file for complete search history.

(56) References Cited

U.S. PATENT DOCUMENTS

| | | | | |
|---|---|---|---|---|
| 341,486 A | | 5/1886 | Keys | |
| 1,606,107 A | * | 11/1926 | Simms | 383/2 |
| 2,015,119 A | * | 9/1935 | McEwen | 383/40 |
| 2,671,486 A | * | 3/1954 | Shaw | 224/610 |
| 2,682,290 A | * | 6/1954 | Ditlea | 383/121 |
| 3,587,698 A | * | 6/1971 | Ritter | 150/116 |
| 4,085,873 A | | 4/1978 | Schweitzer | |
| 4,094,351 A | * | 6/1978 | Catenaccio | 224/609 |
| 4,114,667 A | * | 9/1978 | Belson | 224/613 |
| 4,117,874 A | | 10/1978 | Berenguer | |
| 4,375,111 A | * | 3/1983 | Hall | 5/419 |
| 4,404,687 A | * | 9/1983 | Hager | 2/94 |
| 4,560,096 A | | 12/1985 | Lucas et al. | |
| 4,723,300 A | | 2/1988 | Aranow | |
| 4,782,874 A | | 11/1988 | Chartier | |

(Continued)

FOREIGN PATENT DOCUMENTS

WO WO 2008/150973 12/2008

OTHER PUBLICATIONS

Steven Warner, Fiber Science, UMass, Dartmouth.*

(Continued)

*Primary Examiner* — Jes F Pascua
*Assistant Examiner* — Peter Helvey
(74) *Attorney, Agent, or Firm* — Levine Bagade Han LLP

(57) ABSTRACT

An article, such as a bag, with an attached storage pouch or pocket is disclosed. The pouch can be directly attached to the article through an attachment, placing the pouch within close proximity, or coincident with a portion of the article. The pouch can be made from an elastic, flexible material. The pouch can be attached in an inverted state to an article. A user can place a portion of his hand in the pouch, compress the article with both hands, and then invert the pouch while encapsulating the compressed article in the pouch. The pouch can have a flap attached to the pouch. The flap can be used to close the opening of the pouch.

25 Claims, 10 Drawing Sheets

(56) References Cited

U.S. PATENT DOCUMENTS

| | | | | | |
|---|---|---|---|---|---|
| 4,871,100 | A | | 10/1989 | Posner | |
| 4,944,042 | A | | 7/1990 | DeWan | |
| 5,009,516 | A | | 4/1991 | Geeck | |
| 5,152,612 | A | | 10/1992 | Shoemaker | |
| 5,251,743 | A | | 10/1993 | Pulido et al. | |
| 5,297,872 | A | * | 3/1994 | Caligiuri | 383/86 |
| 5,399,020 | A | * | 3/1995 | Cheng | 383/4 |
| 5,472,280 | A | * | 12/1995 | Rittmaster | 383/6 |
| 5,490,619 | A | | 2/1996 | Boyar | |
| 5,787,504 | A | * | 8/1998 | Wu | 2/93 |
| D411,764 | S | * | 7/1999 | Vazquez | D3/233 |
| 5,988,474 | A | * | 11/1999 | Smith et al. | 224/578 |
| D439,040 | S | * | 3/2001 | Vazquez | D3/233 |
| D441,187 | S | | 5/2001 | Vazquez | |
| D441,525 | S | | 5/2001 | Vazquez | |
| 6,393,638 | B1 | | 5/2002 | MacColl | |
| 6,520,825 | B1 | * | 2/2003 | Herr | 446/71 |
| D516,306 | S | * | 3/2006 | Koenig et al. | D3/233 |
| D516,307 | S | * | 3/2006 | Koenig et al. | D3/233 |
| 7,232,018 | B1 | | 6/2007 | Salander | |
| 2004/0031655 | A1 | * | 2/2004 | Milionta et al. | 190/110 |
| 2006/0196996 | A1 | * | 9/2006 | Clark et al. | 248/104 |
| 2007/0272700 | A1 | * | 11/2007 | Swartz et al. | 220/737 |

OTHER PUBLICATIONS

PCT Patent Application No. PCT/US2008/065249 filed May 30, 2008 in the name of Jariwala et al., International Search Report and Written Opinion mailed Sep. 9, 2008.

* cited by examiner

DEVICE WITH ATTACHED STORAGE POUCH

CROSS-REFERENCE TO RELATED APPLICATION

This application is a continuation of PCT Application No. US08/65249 filed 30 May 2008, which claims priority to U.S. Provisional Application No. 60/932,252, filed 30 May 2007, which are both incorporated by reference herein in their entireties.

BACKGROUND OF THE INVENTION

1. Field of the Invention

The present invention relates to a storage pouch that can be attached to a flexible, compressible article, such as a bag. When the article is not in use, the article can be compacted and stored in the pouch.

2. Description of the Related Art

There are attached storage pouches available on various articles such as bags, jackets, and beach towels. These pouches attached to the article allow the user to store the article in the attached pouch while the article is not in use. When the article is stored in the attached pouch, the article is maintained in a compressed state. This compressed state is advantageous since it makes transporting the article easier when the article is not in use. The compressed state, and the resulting smaller size, also allows the user a greater variety of storage possibilities while transporting the item. An uncompressed article may be too large to fit in a suitcase, purse, or other carry bag, while the article in its compressed state may fit easily into a suitcase, purse, or other carry bag, since transporting the article in a collapsed state allows the user to transport a much less voluminous and cumbersome article. These articles with attached storage pouches are currently available on the market, and are well adopted.

Most articles with attached storage pouches have pouches that are typically cylindrical or rectangular in shape when filled with the article. These pouches are typically constructed from a flexible material. These pouches generally have a single open side. These pouches are usually sewn onto the article on one or more sides of the pouch. Since the pouch is attached, it prevents the pouch from getting lost or otherwise separated from the article. Typically the article is attached to the inside of the pouch so that when the article is in use, the pouch may be in an inverted, inside out state. When a user wishes to bring the article into a compacted state, typically the user brings the pouch into an un-inverted state, if it was previously inverted, and then compacts the article while simultaneously stuffing it into the pouch. Typically, there is a closure for the pouch in the form of a zipper, a cinch cord, or a flap that can be flipped over to cover the pouch opening.

Currently, there are many bags on the market with attached storage pouches. These typically consist of bags made of lightweight synthetic textiles, such as nylon or polyester. One predominant purpose for these bags is for travel. This allows the traveler to compactly stow an extra compressed bag in their suitcase when traveling to their destination. Once the traveler reaches his destination, he can then convert the bag from its compacted state to its uncompacted, usable state.

These bags with attached storage pouches are also frequently used for shopping. While most vendors in the United States provide disposable shopping bags when goods are purchased, many consumers have concerns about the negative environmental impact of using these disposable bags. Many consumers and environmental experts agree that using a reusable bag can reduce the impact to the environment. Many environmentally conscious consumers are eager to make the switch to reusable bags. These consumers frequently purchase standard, non-compactable re-usable bags, often in the form of canvas, or polymer tote bags. Since these bags are noncompactable, they are typically stored at home or in a car trunk. Since they are stored at home or in a car trunk, a consumer must remember to bring the bag with them into a store when shopping. With these non-compactable re-usable bags, consumers frequently fail to remember to bring them when shopping, often leaving the bag at home. Even when the non-compactable re-usable bags are stored in a car trunk, and the car with the re-usable bags is driven to the store for shopping, consumers fail to remember to bring the bags with them into the store. Frequently, consumers only realize that they have forgotten their re-usable bags once they have reached the checkout line.

A more successful re-usable bag option is the compactable re-usable bag with attached pouch, which when compressed can be housed in a purse, pocket, messenger bag, or backpack. Since many shoppers bring a purse, messenger bag, backpack, or have an available pocket with them when shopping, the compacted bag already housed in one these places will be available when it's needed for shopping. With the compacted bag, the user does not need to make a specific effort to remember the bag, since it can consistently housed in a purse, pocket, messenger bag, or backpack that is already likely to be with the consumer during a shopping trip.

These reusable compact shopping bags with attached storage pouches are typically made out of lightweight synthetic textiles, such a nylon or polyester. Given the durable nature of the bag materials, these bags can be used repeatedly. These bags, which are marketed for shopping, are typically sized similar to traditional plastic or paper grocery bags when in their uncompressed state. When compacted, these bags are typically sized to fit into a purse, or pocket. Once items have been purchased from a store, the user can transform the bag to its uncompressed state, and place purchased items in the bag for transport to their home, or desired destination.

While consumers enjoy the benefits on being able to convert an article into a compacted state using the attached storage pouch, the process itself is often cumbersome. Typically, a user struggles to compress a portion of the article while simultaneously trying to stuff the compressed portion through the pouch opening. Usually, the opening of the attached pouch is relatively small in comparison to the size of the article, further making the process of passing the entire article through the opening difficult. Given this size of the opening in relation to the size of the article, in some cases, it even necessitates the user having to fold or roll the article prior to passing it through the opening.

Additionally, since many of the pouches utilize zippers as the closure mechanism, the article frequently gets caught in the zipper, during the process of zipping and closing the pouch opening. As a result, it takes a good deal of time and effort to compact the article, often resulting in users not bothering to convert the article back into its compacted state, although the user might find it preferable.

Other pouches are tethered at a distance from the bag, making compacting difficult and necessitating the bag to be both compressed and moved to the pouch. The tethering also introduces additional failure points, since the tether must be attached to the bag at first and second ends, either of which could fail. The tether also increases production costs since the tether itself needs to be acquired, and an extra attachment (e.g., between the tether and the bag) needs to be formed.

The storage pouches on the market today are of conventional, very utilitarian shape when filled. Little can be done with the compacted article in the pouch, nor does it provide any entertainment value. Given the difficulty in getting the article back into the pouch, along with the lack of entertainment value, many consumers don't bother to convert the article into its compressed state. In the case when the article is a compactable reusable shopping bags, these means that users fail to bring the bags with them when shopping, since the uncompressed re-usable shopping bags are too large to easily house in a bag or purse, pocket, messenger bag, or backpack.

SUMMARY OF THE INVENTION

A collapsible carrying device having an article, such as a bag, and a pocket (also referred to herein as a pouch) attached to the bag is disclosed. The pouch is attached to the bag by one or more attachment elements or integral with the bag.

The pouch can be made from an elastic, flexible material. With the device in a first configuration, the pouch can be attached in an inverted state to the bag. When the article is in the first configuration, a user can place a portion of his hand in the pouch, compress the bag with one or both hands, and then invert the pouch while encapsulating the compressed article. The pouch can have a flap attached to the pouch which may be used to close off the opening of the pouch.

The pouch can have three stacked panels. The panels can be stacked in order starting with a first panel (i.e., panel one) and ending with a third panel (i.e., panel three). The first and third panels can be rectangular with a rounded semicircular edge (i.e., U-shaped edge) at the bottom of the panels. The second panel can be the same shape as the first and third panels, but can lack a rounded semicircular bottom. Two or all of the panels can be all aligned about the top straight edge of the panels. The first and third panels can be attached to each other along their U-shaped edge, but remain unattached along their top portions. The second panel, which can be sandwiched between the first and third panels can be attached to the first panel along a circular arc. This circular arc can open downward towards the base of the U-shape formed by the first panel. The ends of the second panel's circular arc can meet the attached rounded semicircular edges of the first and third panels.

When the article is in the first configuration, the pouch can be in an unfilled and inverted configuration and the bag can be open and filled with, or capable of being filled with items to be stored in the bag (e.g., groceries).

The user can stretch the pouch and pack the bag into a compressed configuration in the pouch. The user can place all or a portion of the user's fingers and/or thumb on one or both hands, for example between the second and third panels, into the inverted pouch. For example, when at least some fingers of one hand are completely or partially in the pouch, the user then can use one or both hands, including the hand(s) in the pouch, to bring the bag into a compressed configuration, for example by bunching and/or folding the bag. With the bag in a compressed configuration, the user can then stretch the first, second and/or third panels over the compressed bag, converting the pouch into an uninverted configuration (e.g., right-side out). Some or all of the panels and the material from which the panels is made can be elastic. The user can then stretch the second panel (for example a flap) over the opening of the pouch to cover the pouch opening, and completely secure the bag within the pouch. The second panel, such as an elastic flap, can be in tension across the opening of the pouch, securing the bag in a compressed state in the pouch.

The pouch filled with the bag, and possibly closed, can form a generally spherical configuration, or can be otherwise configured as a ball. The filled pouch can then be used for recreation, for example being thrown, tossed or kicked by the user. The bag can be easily compressed and stored in the pouch and the pouch can be used for recreation as a ball.

The bag-filled pouch can be stored the in a purse or carry bag, and then have the re-usable compressed bag available for shopping, and can reduce the environmental impact of the bag (i.e., by reusing the bag instead of throwing away numerous shopping bags).

The bag can be made from a flexible material that can be elastic or inelastic. The bag material can be flexible enough to allow compression of the shape of the bag easily, getting the bag into a compressed configuration within the pouch.

The configuration of the filled pouch, for example a spherical or football-shaped ball, can provide recreational value. The filled pouch can also have a rectangular or cylindrical configuration.

When the filled pouch has a rectangular form, the pouch can have three stacked panels, stacked in order starting with the first panel (i.e., panel one) and ending with the third panel (i.e., panel three). The first and third panels can be rectangular in shape. The second panel can be rectangular in shape and smaller in one dimension than the first and third panels. Two or all of the panels can be aligned with respect to their top straight edge. The first and third panels can be attached to each other along their side and bottom edges. The first and third panels can be unattached along their top edges. The second panel, which can be sandwiched between the first and third panels, can be attached to the first panel along the first panel's top and side edges.

DETAILED DESCRIPTION OF THE INVENTION

A collapsible carrying device having an article, such as a bag, and a pocket (also referred to herein as a pouch) attached to the bag is disclosed. The pouch can be attached to the bag by one or more attachment elements or integral with the bag. The pouch can be in close proximity, adjacent, coincident or integral with a portion of the bag. The article can be a bag, jacket, coat, beach towel, shirt, pant, jump suit, other clothing, or combinations thereof. The bag can be a purse, shopping bag, over-the-shoulder bag, duffle bag, handbag, trash bag, suitcase, or food containment (e.g., sandwich or freezer) bag.

FIGS. 1 through 18 illustrate that the filled pouch can have a substantially spherical or otherwise ball-like configuration. The bag can be flexible. The bag can have a configuration that can be compressed into the pouch.

Figure 1:
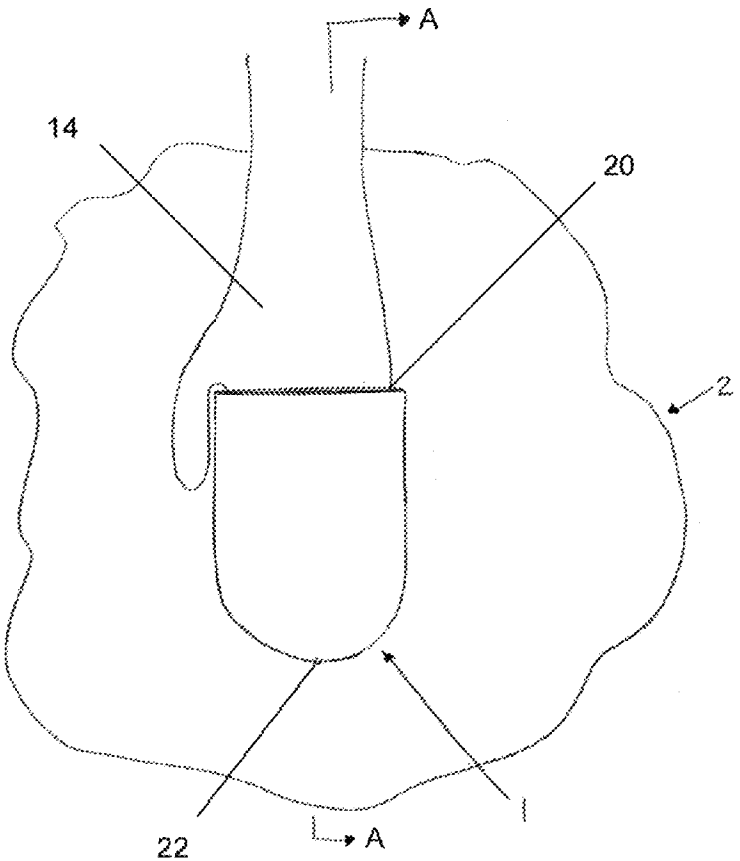
FIG. 1 is a front view of a variation of the pouch and a portion of the bag onto which the pouch is attached.

FIG. 1 illustrates that the bag 2 can have the pouch 1. Pouch 1 can be attached to and/or integral with the surface of bag 2. Pouch 1 can be attached to bag 2 by a direct, fixed attachment. The direct attachment can be directly between the bag 2 and the pouch 1, for example with no tether between the pouch and the bag. The fixed attachment can have one or more stitches, adhesive, rivets, or combinations thereof. Pouch 1 can be integrated to the bag by being a part of the fabric of the bag and/or being heat sealed to the bag 2.

The location of the attachment and/or integration of the bag 2 and the pouch 1 can be along a first attachment zone 20 and a second attachment zone 22. The first attachment zone 20 can include an edge of the pocket adjacent to an opening of the pocket. Any or all attachment zones can include the pouch 1 sewn, and/or otherwise attached, directly to the bag 2. The second attachment zone 22 can be away from the opening of the pouch 1. The first section 24 of the pouch 1 can be attached to the bag 2 or left unattached (directly, but indirectly attached via the attachment zones 20 and 22) to the bag 2.

The pouch 1 can be attached to the bag by a removable attachment. The removable attachment can be, for example, one or more snaps, zippers, hook and loop (e.g., Velcro) tapes, or combinations thereof. The pocket 1 can be zipper-free.

The digits of the user's left hand, excluding or including the thumb, can be inserted into pouch 1.

Figure 2:
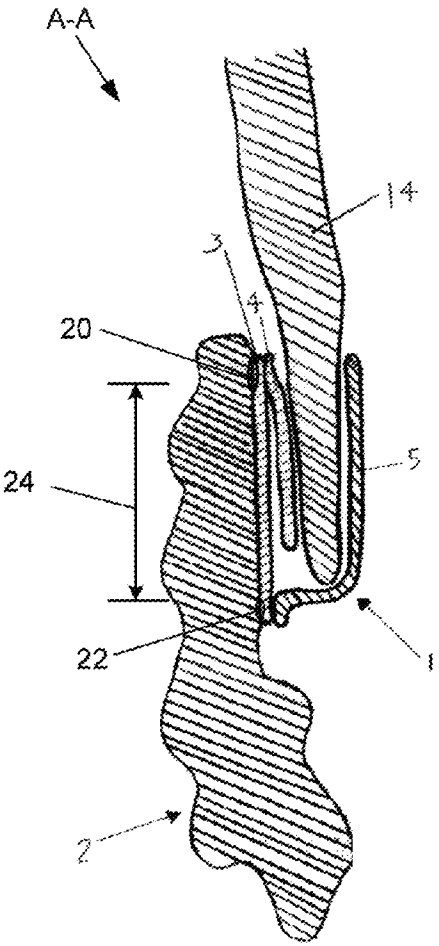
FIG. 2 is cross section A-A of a variation of FIG. 1.

FIG. 2 illustrates that the pouch 1 can be attached onto the surface of bag 2. Pouch 1 can have first, second and third panels 3, 4, and 5, or combinations thereof. The second panel 4 can be attached to the first panel 3. The third panel 5 can be attached to the first panel 3. (The panel numbers can be used interchangeably.) All or parts of the digits of the user's left hand 14 including or excluding the thumb, can be inside pouch 1 between second and third panels 4 and 5. Pouch 1 can be in an inverted, inside-out, configuration, for example as shown in FIG. 2.

Figure 3:
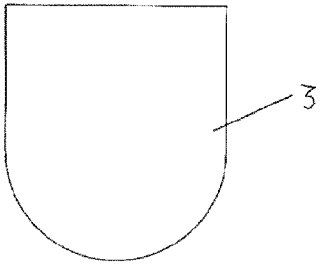
FIG. 3 is a front view of a variation of the first panel of the pouch.
Figure 5:
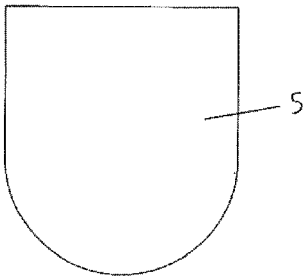
FIG. 5 is a front view of a variation of the third panel of the pouch.

FIGS. 3 and 5 illustrate that the first and third panels 3 and 5, respectively, can have u-shaped configurations. The first panel 3 can be about the same size and configuration as the third panel 5.

Figure 4:
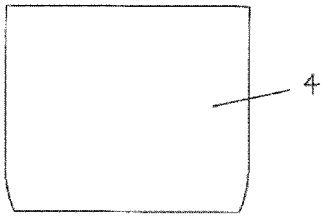
FIG. 4 is a front view of a variation of the second panel of the pouch.

FIG. 4 illustrates that the second panel 4 can have a substantially rectangular configuration. The second panel 4 can have curvature at the bottom corners of the second panel 4.

Figure 6:
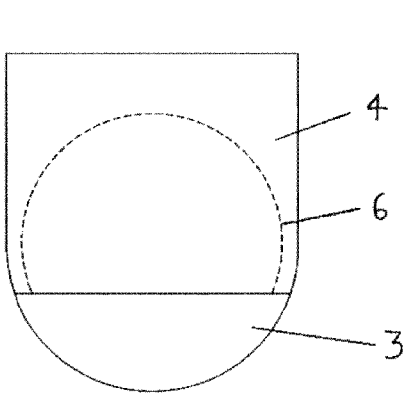
FIG. 6 is a front view of a variation of the second panel of the pouch attached to the first panel of the pouch.

FIG. 6 illustrates that the second panel 4 can be attached to and/or integral with the first panel 3. Second panel 4 can be layered directly on first panel 3. The first and second panels 3 and 4 can be secured (e.g., attached and/or integrated) to each other, for example at the first securing element 6. The securing element can include any of the attachment and/or integration elements described herein.

Figure 7:
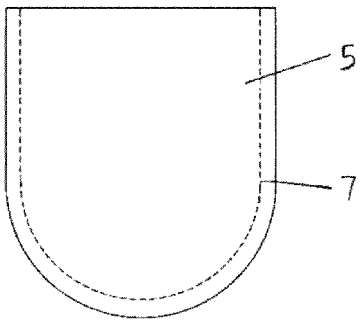
FIG. 7 is a front view of a variation of the third panel of the pouch attached to the first and second panels of the pouch.

FIG. 7 illustrates that the third panel 5 of the pouch can be attached to and/or integrated with the first and/or second panels 3 and/or 4 of the pouch 1. Third panel 5 can be layered directly on the first and second panels 3 and 4, for example, as shown in FIG. 6. Third panel 5 can be secured to panels 3 and 4 at the second securing element 7.

FIGS. 8 through 18 illustrate a variation of an ordered, serial method for storing a collapsible carrying device that can have a bag and an elastic pocket. The method can include compressing and securing the bag within the attached elastic pouch or pocket.

Figure 8:
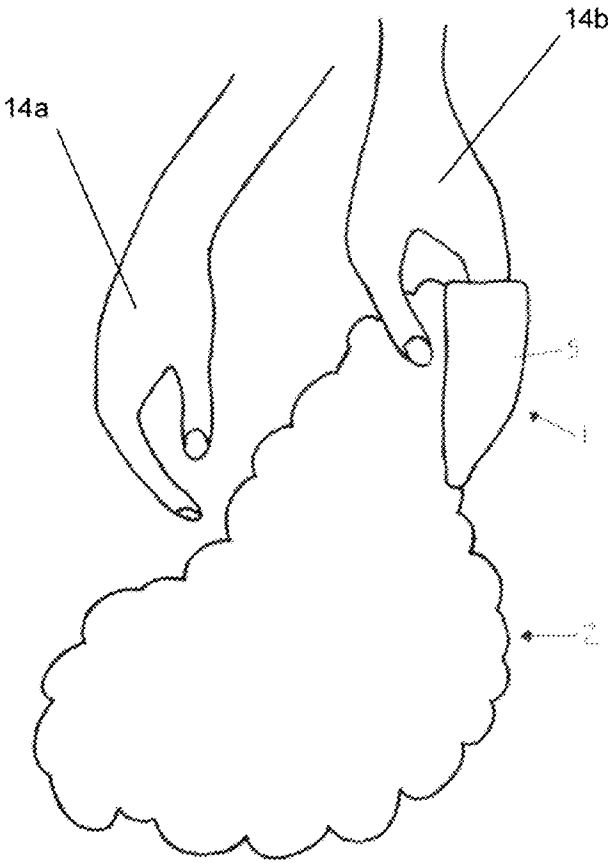
FIG. 8 illustrates a variation of a method of placing a portion of the user's hand into the pouch.

FIG. 8 illustrates that a user can place his left hand into the attached pouch. Bag 2 can be in an uncompressed state. The digits of the user's left hand including or excluding the thumb, can be inside pouch 1. The user's right hand can remain away from the other elements. Pouch 1 can have an inverted, inside-out configuration.

Figure 9:
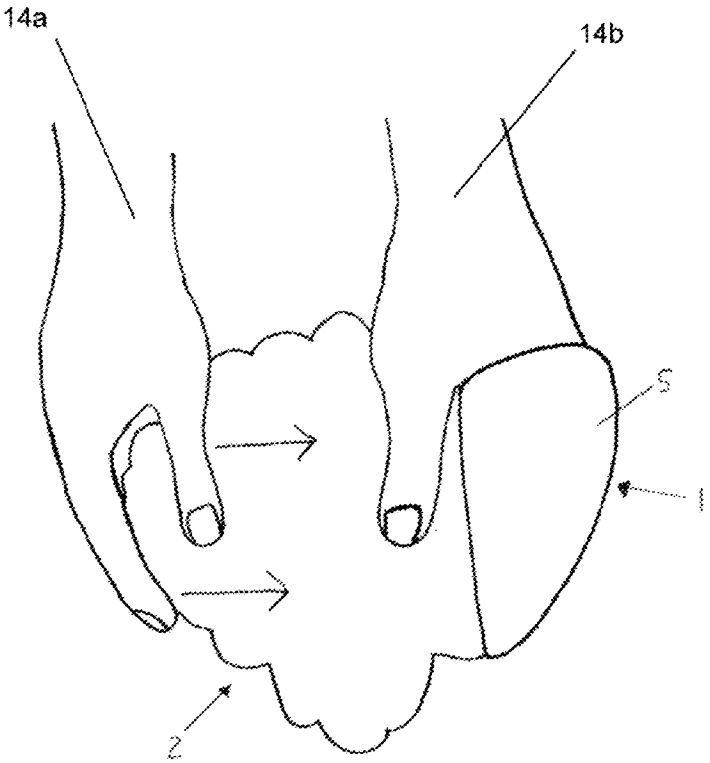
FIG. 9 illustrates a variation of a method of using both hands to compact the bag while a portion of the digits of the user's left hand, excluding his left thumb, are in the pouch.

FIG. 9 illustrates that a user can use both hands 14*a* and 14*b* to compact, as shown by arrows, bag 2. The digits of the user's left hand 14*b*, including or excluding his left thumb, can be inside pouch 1. The right hand 14*a* can compress and scrunch or fold the bag 2. Bag 2 can be in a semi-compressed configuration. Pouch 1 can be in an inverted, inside-out configuration.

Figure 10:
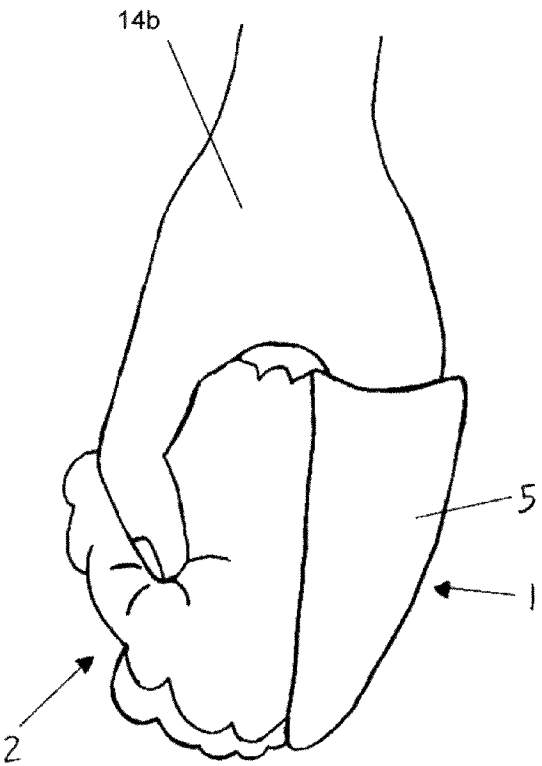
FIG. 10 illustrates a variation of a method of holding the bag in a compressed state between the user's left thumb and the remaining digits of his left hand which are inside the pouch.

FIG. 10 illustrates that the user can hold bag 2 in a compressed configuration between the user's left thumb and the remaining digits of the user's left hand 14*b*. The fingers and/or thumb of the left hand 14*b* can be inside or outside of the pouch 1. The user can hold bag 2 in a compressed configuration between his left thumb and the remaining digits of his left hand inside pouch 1. Pouch 1 can be in an inverted, inside-out configuration.

Figure 11:
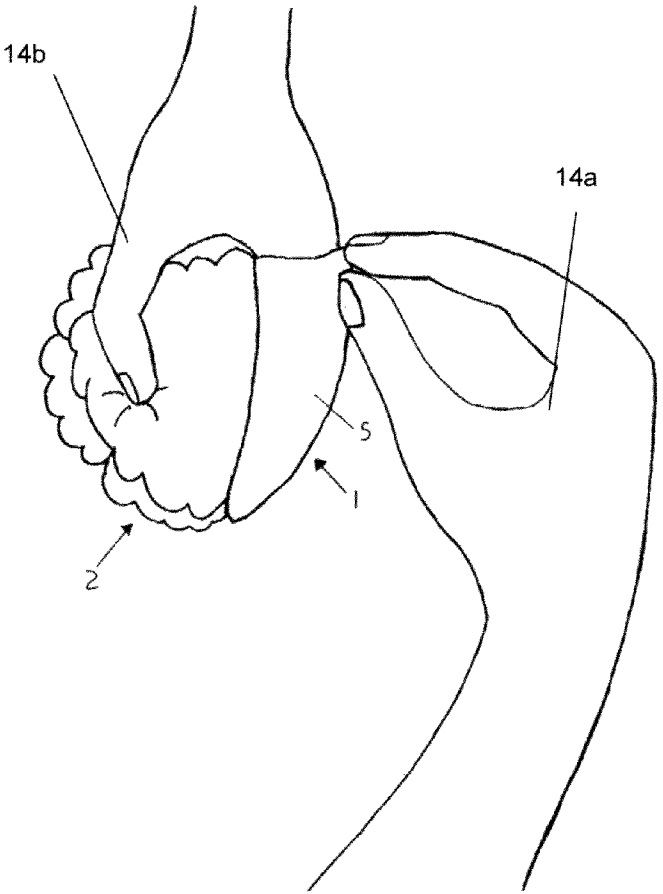
FIG. 11 illustrates a variation of a method of holding the bag in a compressed configuration between the user's left thumb and the remaining digits of his left hand which are inside the pouch. The user's right hang is shown grasping the third panel of the pouch.

FIG. 11 illustrates that the user can use the right hand 14*a* to grasp the third panel 5.

Figure 12:
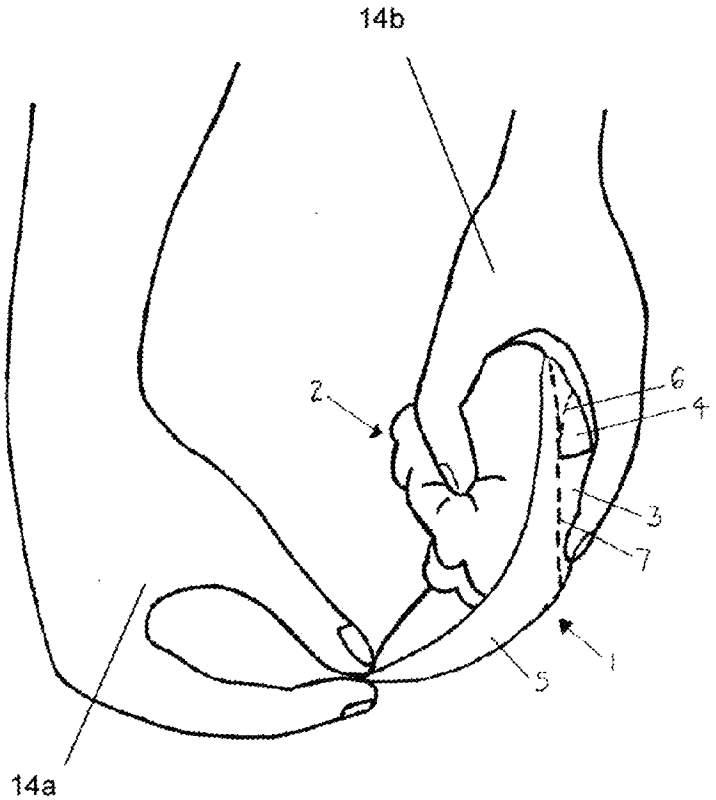
FIG. 12 illustrates a variation of a method of holding the compressed bag between the user's left thumb and the remaining digits of his left hand. The user's right hand is shown beginning to stretch the third panel of the pouch over the compressed bag.

FIG. 12 illustrates that the digits of the left hand 14*b*, including or excluding the thumb, can be positioned against the first and second panels, 3 and 4 respectively. The right hand 14*a* can stretch third panel 5 over the compressed bag 2. For example, when third panel 5 is being stretched over compressed bag 2, all of the digits of the left hand 14*b* can be outside of the pouch 1. Pouch 1 can be in an inverted inside-out configuration and/or an un-inverted right-side out configuration, or combinations thereof.

Figure 13:
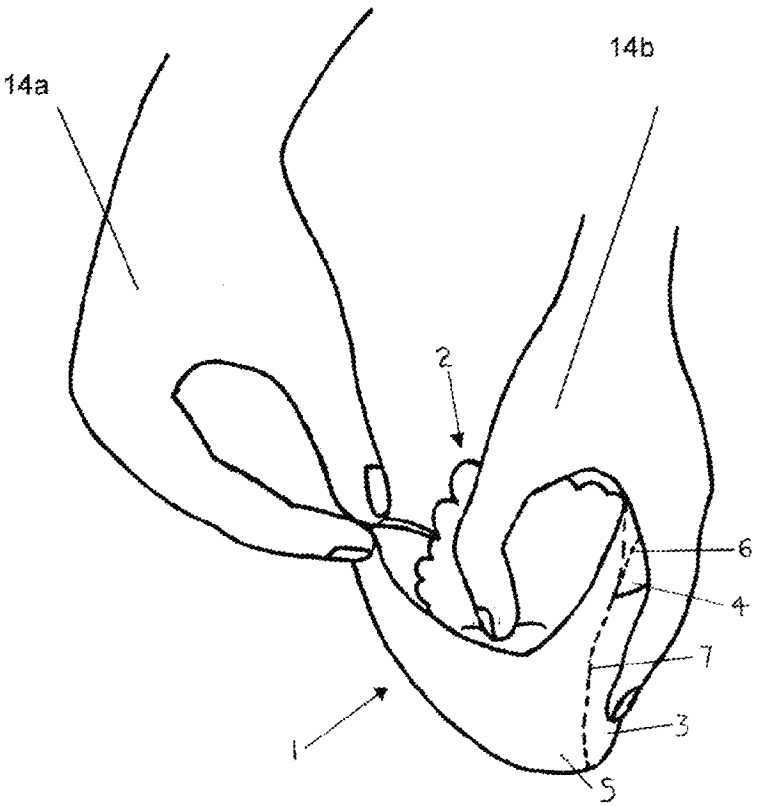
FIG. 13 illustrates a variation of a method of holding the compressed bag between the user's left thumb and the remaining digits of his left hand. The user's right hand is shown stretching the third panel of the pouch over the compressed bag.

FIG. 13 illustrates holding compressed bag 2 between the left thumb and the remaining digits of the left hand 14*b*. The digits of the left hand 14*b*, including or excluding the thumb, can be against the first and second panels 3 and 4. The right hand 14*a* can further stretch third panel 5 over compressed bag 2. Pocket 1 can be in an inverted inside-out configuration and/or an un-inverted right-side out configuration, or combinations thereof.

Figure 14:
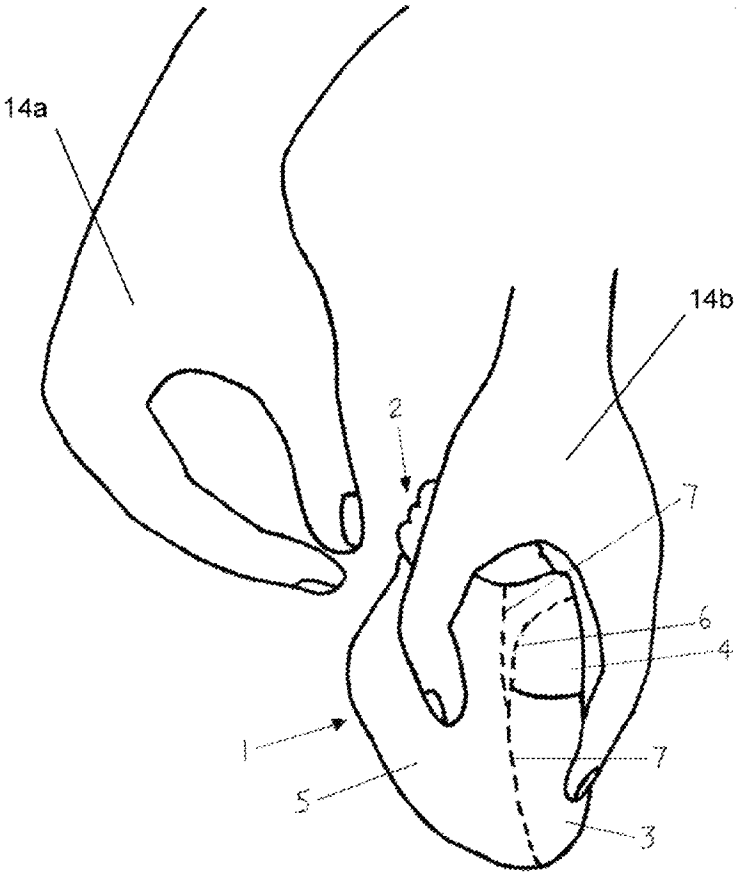
FIG. 14 illustrates a variation of a method of holding the pouch with the third panel of the pouch stretched over the compressed bag.

FIG. 14 illustrates holding pouch 1 with third panel 5 of pouch 1 stretched over compressed bag 2. The left thumb can be positioned against the third panel 5. The remaining (non-thumb) digits of the left hand 14*b* can be positioned against the first and second panels 3 and 4. Pouch 1 can be in an inverted inside-out configuration and/or an un-inverted right-side out configuration, or combinations thereof.

Figure 15:
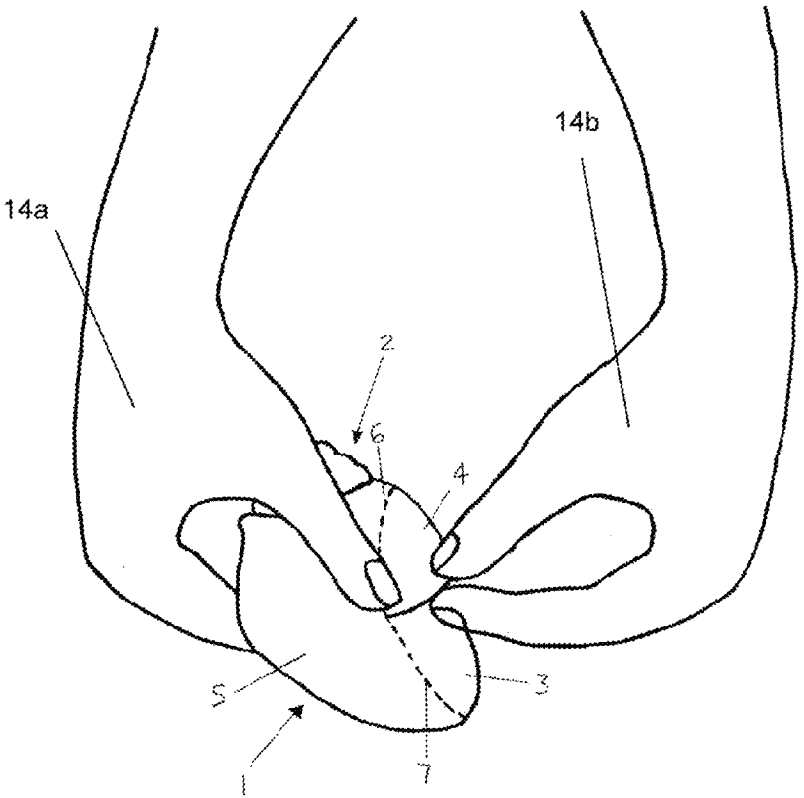
FIG. 15 illustrates a variation of a method of grasping the second panel with the user's left hand while the third panel of the pouch is stretched over the compressed bag.

FIG. 15 illustrates pouch 1 with third panel 5 of pouch 1 stretched over the compressed article 2. Article 2 can be compressed between the third panel wall 5 and the first and second panel walls, 3 and 4 respectively. The user can grasp second panel 4 with his left hand. The panel attachment lines 6 and 7 are depicted with dashed lines. Pouch 1 can be between the inverted inside-out configuration and the uninverted right-side out configuration.

Figure 16:
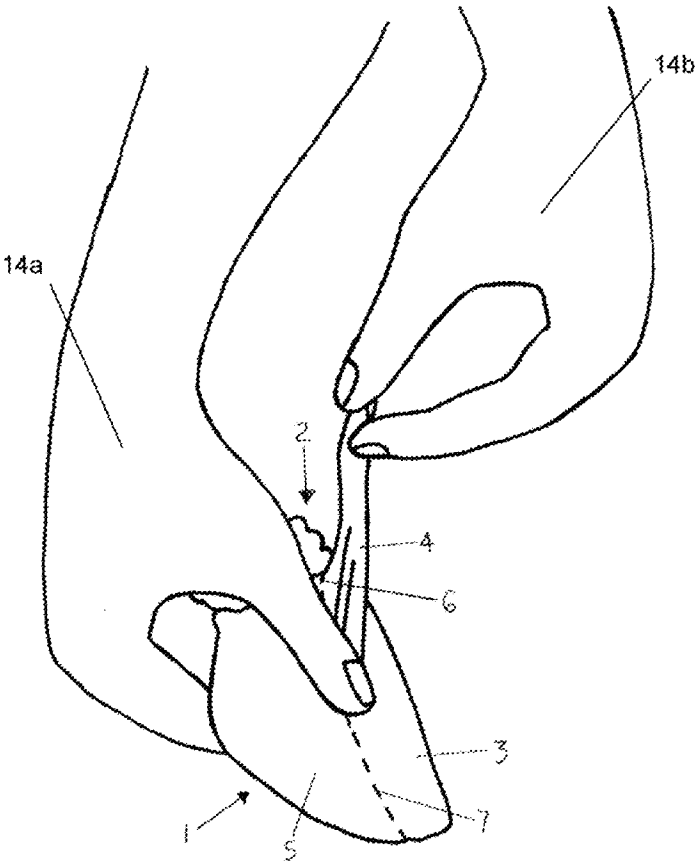
FIG. 16 illustrates a variation of a method of stretching the second panel upward in preparation to cover the opening of the pouch with the third panel of the pouch stretched over the compressed bag.

FIG. 16 illustrates pouch 1 with third panel 5 of pouch 1 stretched over compressed article 2. The user can stretch second panel 4 upward over the opening of the pouch. Panel attachment lines 6 and 7 are depicted with dashed lines. Pouch 1 can be between the inverted inside-out configuration and uninverted right-side out configuration.

Figure 17:
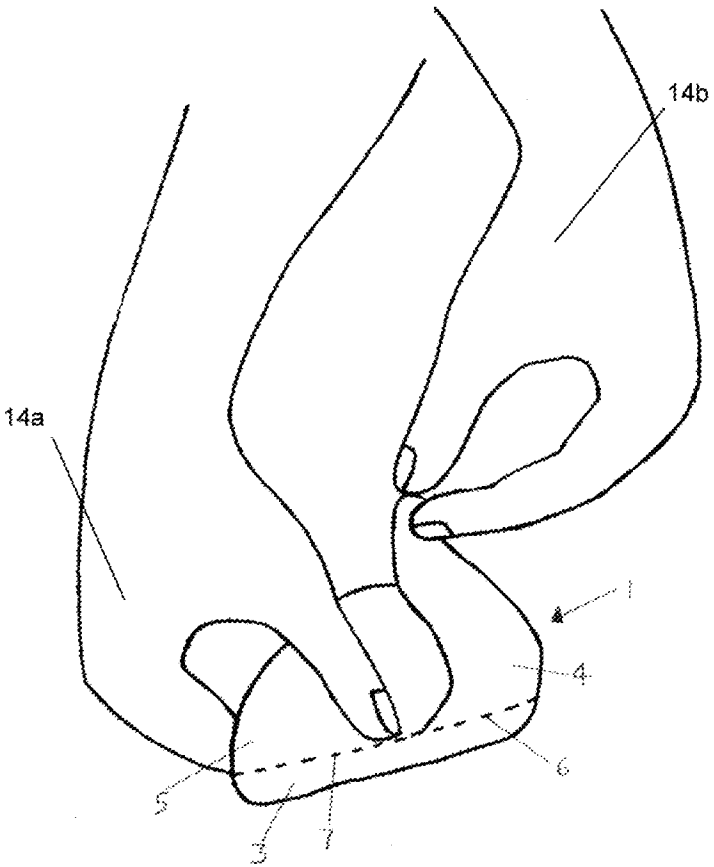
FIG. 17 illustrates a variation of a method of stretching the second panel to cover the opening of the pouch while the third panel of the pouch is stretched over the compressed bag.

FIG. 17 illustrates pouch 1 with third panel 5 of the pouch stretched over compressed article 2. The user can stretch second panel 4 to cover the opening of the pouch. Panel attachment lines 6 and 7 are depicted with dashed lines. Pouch 1 can be between the inverted inside-out configuration and the uninverted right-side out configuration.

Figure 18:
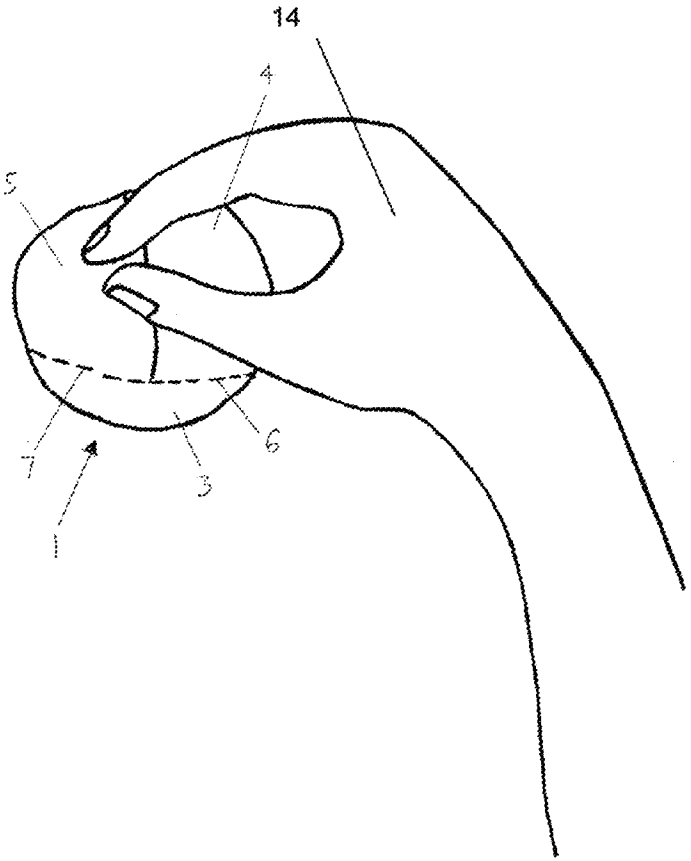
FIG. 18 illustrates a variation of a method of securing the bag in the pouch, with the third panel of the pouch having been stretched over the compressed bag, and the second panel having been stretched over the opening of the pouch.

FIG. 18 illustrates pouch 1 with third panel 5 of the pouch stretched over the compressed article 2, and second panel 4 stretched over the opening of the pouch. The article 2 can be substantially completely secured in a compressed state within pouch 1. Panel attachment lines 6 and 7 are depicted with dashed lines. Pouch 1 can be substantially completely in the uninverted right-side out configuration.

FIGS. 19-25 illustrate that the filled pouch can have a stuffed rectangle configuration.

Figure 19:
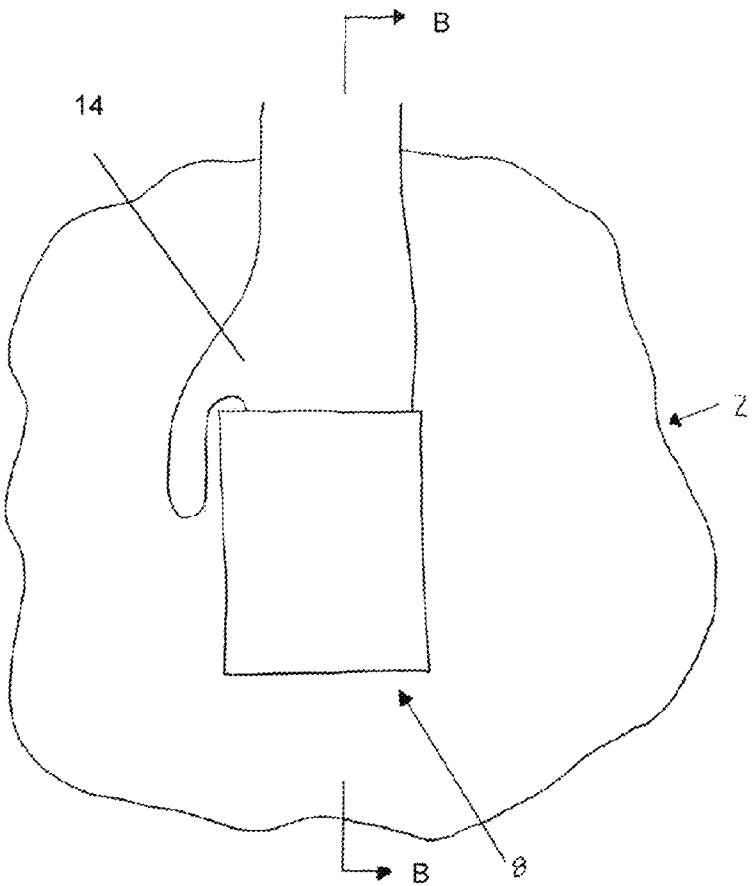
FIG. 19 is a front view of a variation of the pouch and the article.

FIG. 19 illustrates a front view of a variation of the pouch and the article 2. Pouch 8 can have a rectangular configuration. Pouch 8 can be attached to the surface of article 2. The digits of the user's left hand, excluding the thumb, can be inserted into pouch 8.

Figure 20:
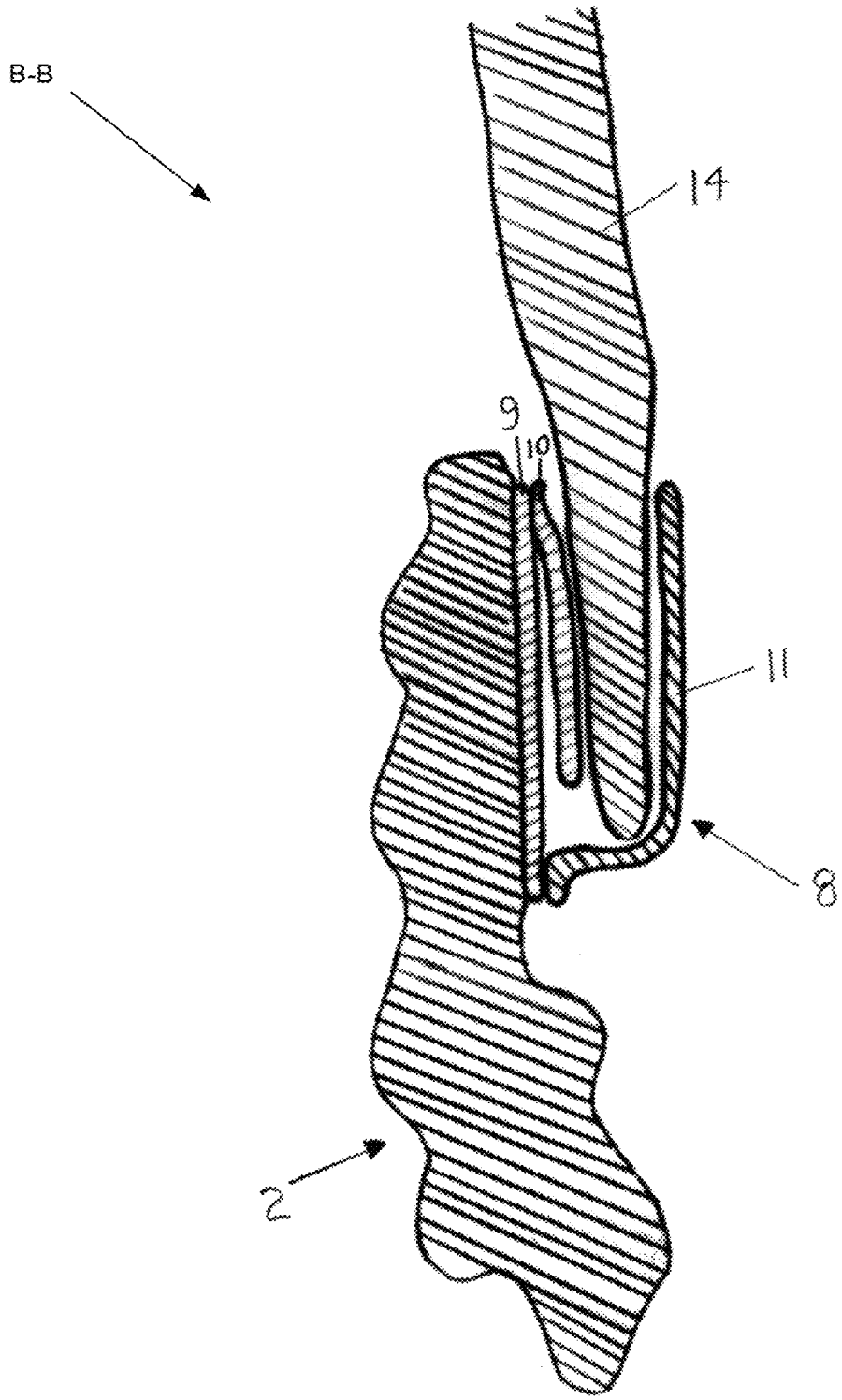
FIG. 20 is cross sectional view B-B of a variation of FIG. 19.

FIG. 20 illustrates a cross-sectional view of the pouch, the article 2, and a portion of the user's left hand. Pouch 8 can be attached onto the surface of article 2. Pouch 8 can have panels 9, 10, and 11. The digits of the user's left hand excluding the thumb, 14, can be inside pouch 8, between panels 10 and 11. Pouch 8 can be in an inverted configuration.

Figure 21:
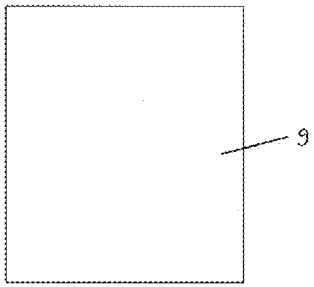
FIGS. 21, 22 and 23 are front views of variations of the first, second and third panels, respectively.
Figure 22:
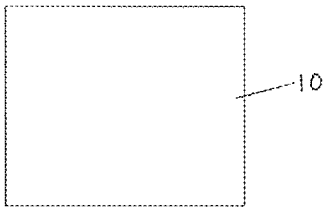
Figure 23:
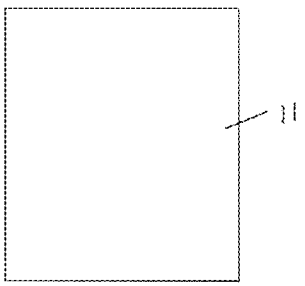

FIGS. 21, 22 and 23 illustrate front views of variations of first panel 9, second panel 10 and third panel 11, respectively. The pouch can have a rectangular configuration. The panels 9, 10 and 11 can have rectangular configurations.

Figure 24:
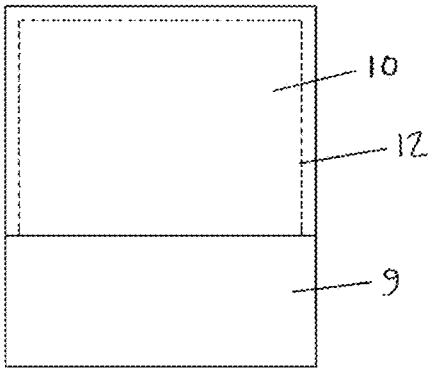
FIG. 24 is a front view of a variation of the pouch where the second panel of the pouch is attached to the first panel of the pouch.

FIG. 24 is a front view of the pouch that can have the second panel of pouch 10 attached to first panel 9 of the pouch. The pouch can have a rectangular configuration. The second panel 10 can be on top of first panel 9. First panel 9 can be secured to second panel 10, for example, along first attachment 12.

Figure 25:
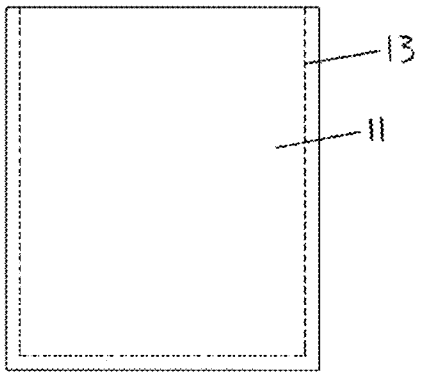
FIG. 25 is a front view of a variation of the pouch where the third panel of the pouch is attached to the first and second panels of the pouch.

FIG. 25 is a front view of the pouch that can have the third panel 11 of the pouch attached to the first and second panels 9 and 10, respectively, of the pouch. Third panel 11 can be on top of the first and second panels, 9 and 10 of any of the variations shown herein. Panel 11 can be secured to panels 9 and 10 along second attachment 13.

The flap (e.g., second panel 10 or 4) can be opened and the pocket 1 can be uninverted to withdraw the bag 2 from the pouch 1. For example, the reverse of the methods described herein can be performed to remove the bag 2 from the pouch 1.

As these variations are described with reference to the aforementioned drawings, various modifications, combinations or adaptations of the elements of the methods and or specific structures described are implicit herein. All such modifications, adaptations, combinations, or variations that rely upon the teachings of the present invention and through which these teachings have advanced the art, are considered to be within the spirit and scope of the present invention. Hence, these descriptions and drawings are not to be considered in a limiting sense as it is understood that the present invention is in no way limited to the embodiments illustrated.

We claim:

1. A collapsible device comprising:

an article, wherein the article is compressible and wherein the article is substantially flexible, and wherein the article has an article opening; and a pocket attached to the article at a first direct attachment and a second direct attachment;

wherein the pocket has a pocket opening and wherein the pocket comprises a first panel, a second panel, and a third panel, and wherein the first panel is directly attached to the second panel, and wherein the third panel is directly attached to the first panel, and wherein the first panel is between the second panel and the article; and wherein at least one of the panels is substantially elastic;

wherein the pocket opening opens in the same direction that the article opening opens when the pocket is in a relaxed configuration; and wherein when the article is inside the pocket, at least one of the panels is stretched and in tension, and the pocket has a spherical configuration.

2. The device of claim 1, wherein at least one of the panels is an integral portion of the article.

3. The device of claim 1, wherein the direct attachment comprises a fixed attachment.

4. The device of claim 1, wherein the direct attachment comprises a stitch.

5. The device of claim 1, wherein the direct attachment comprises adhesive.

6. The device of claim 1, wherein the direct attachment comprises a rivet.

7. The device of claim 3, wherein the first panel is heat-sealed to the article.

8. The device of claim 1, wherein the first panel comprises a flap.

9. The device of claim 1, wherein the pocket is substantially zipper-free.

10. The device of claim 1, wherein an edge of the pocket is sewn directly to the article.

11. A collapsible device comprising:

an article having an article opening, wherein the article is compressible and wherein the article is substantially flexible;

an elastic pocket, wherein the pocket has a pocket opening and wherein the pocket comprises a substantially elastic first panel, a substantially elastic second panel, and a substantially elastic flap, and wherein the first panel is directly attached to the second panel; and a first fixed attachment and a second fixed attachment attaching the pocket to the article; and wherein the article comprises a first material, and wherein the pocket comprises a second material, and wherein the first material is a different material than the second material;

wherein when the article is inside the pocket, the first panel, second panel, and the flap are stretched and in tension, and the pocket is in a spherical configuration; and wherein when the pocket is in a relaxed configuration, the article opening opens in the same direction as the pocket opening opens.

12. The device of claim 11, wherein the fixed attachment comprises a first stitch line adjacent to the opening of the pocket, and further comprising a second stitch away from the opening of the pocket, wherein the article is not attached to the pocket in the section between the first stitch and the second stitch.

13. A method of storing a collapsible device comprising an article and an elastic pocket, wherein the article is compressible and flexible, and wherein the pocket is attached to the article, wherein the pocket comprises a first panel, a second panel, and a third panel, and wherein at least the second panel is elastic, and wherein the first panel is attached to the second panel, comprising:

compressing the article;

pushing the article into the pocket, and wherein pushing the article into the pocket comprises stretching the pocket and elastically expanding the panels that are elastic;

inverting the pocket; and maintaining the article in a compressed configuration in the pocket in a spherical configuration;

wherein the pushing comprises pushing the article adjacent to the pocket directly into the pocket, between the first and second panels on a first side of the article and the third panel on a second side of the article; and wherein inverting the pocket comprises stretching the second panel over the article and at least a portion of the third panel.

14. The method of claim 13, wherein compressing comprises scrunching the article.

15. The method of claim 13, wherein compressing comprises folding the article.

16. The method of claim 13, wherein the compressing is at least partially concurrent with the pushing.

17. The method of claim 13, wherein inverting comprises inverting the article into an inside-out configuration.

18. The method of claim 13, further comprising releasing the article from the pocket, wherein releasing comprises uninverting the pocket.

19. The device of claim 1, wherein the article comprises a bag.

20. The device of claim 11, wherein the direct attachment comprises a stitch.

21. The device of claim 11, wherein the direct attachment comprises an adhesive.

22. The device of claim 11, wherein the direct attachment comprises a rivet.

23. The device of claim 11, wherein the direct attachment comprises a heat seal.

24. The device of claim 1, wherein the direct attachment comprises a snap.

25. The device of claim 1, wherein the direct attachment comprises a hook and loop fastener.

* * * * *